US006367731B1

(12) United States Patent
Takizawa et al.

(10) Patent No.: US 6,367,731 B1
(45) Date of Patent: Apr. 9, 2002

(54) ROLL PAPER PULLING LOAD-BUFFERING DEVICE FOR A PRINTER

(75) Inventors: Hiroshi Takizawa, Shiojiri; Manabu Shimizu, Matsumoto; Hiroshi Shikano, Ogaki, all of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/611,508

(22) Filed: Jul. 7, 2000

(30) Foreign Application Priority Data

Jul. 9, 1999 (JP) ..... 11-196608

(51) Int. Cl.[7] ..... B65H 23/16; B65H 23/08
(52) U.S. Cl. ..... 242/417.3; 242/563
(58) Field of Search ..... 242/417.3, 563, 242/563.2, 420.6, 421.5, 421.6, 421.7

(56) References Cited

U.S. PATENT DOCUMENTS

| | | | | | |
|---|---|---|---|---|---|
| 1,988,255 | A | * | 1/1935 | Soons | 242/563 |
| 3,507,459 | A | * | 4/1970 | Campbell | 242/421.6 |
| 3,912,191 | A | * | 10/1975 | Anderson et al. | 242/417.3 |
| 3,963,191 | A | * | 6/1976 | Goodley | 242/417.3 |
| 4,555,071 | A | * | 11/1985 | Nordlof | 242/420.6 |
| 4,913,366 | A | * | 4/1990 | Andou | 242/563.2 |
| 4,958,782 | A | * | 9/1990 | Dannatt et al. | 242/417.3 |
| 5,653,402 | A | * | 8/1997 | Nakano | 242/563 |
| 5,758,982 | A | * | 6/1998 | Yoshida et al. | 242/563 |
| 5,884,861 | A | * | 3/1999 | Hosomi et al. | 242/563 |

FOREIGN PATENT DOCUMENTS

| | | |
|---|---|---|
| JP | 57-159461 | 3/1956 |
| JP | 57-174450 | 4/1956 |
| JP | 58-095061 | 6/1983 |
| JP | 58-130853 | 8/1983 |
| JP | 59-055777 | 3/1984 |
| JP | 2-61860 | 9/1990 |

* cited by examiner

*Primary Examiner*—John M. Jillions
(74) *Attorney, Agent, or Firm*—Hogan & Hartson, L.L.P.

(57) ABSTRACT

A roll paper pulling load-buffering device enables smooth roll paper transportation and minimizes the space required for its installation in the printer. The load-buffering device has an arm 22*a* that moves a specified angle around the shaft 24 on which the roll paper turns. A roller 23 extends widthwise to the roll paper from the arm 22*a* at a point offset from the outside diameter of the roll. Paper pulled off the roll is draped around this roller 23. When a transportation roller is driven to advance paper from the roll by pulling from the end of the roll, tension applied to the paper causes the arm 22*a* to turn in one direction by way of the intervening roller 23. An urging means 25 such as a spring then urges the roller 23 and arm 22*a* in the opposite direction, maintaining even tension on both sides of the roller 23 and thereby enabling smooth roll paper transportation.

20 Claims, 11 Drawing Sheets

ROLL PAPER PULLING LOAD-BUFFERING DEVICE FOR A PRINTER

BACKGROUND OF THE INVENTION

1. Field of the Invention

The present invention relates to a printer in which roll paper is pulled by the end thereof and supplied to a printing unit by advancement of a transportation roller, and the printer prints to the surface of the supplied roll paper, and relates more particularly to a pulling load-buffering device for buffering the load acting on the roll paper when the roll paper is thus pulled.

2. Description of Related Art

Printers which internally house roll paper, that is, a long length of recording medium in roll form, and which pull this paper by means of a transportation roller to print to the surface of the paper, are widely known. It is generally preferable to install a large diameter roll of paper in this type of printer to reduce the frequency of roll paper replacement. A problem with this is that as roll paper diameter increases, great tension acts on the pulled part of the paper as a result of the inertia tending to keep the roll paper stationary when it is pulled. This produces slippage between the transportation roller and paper, and can cause the paper to tear. A number of load-buffering devices for reducing the load on the roll paper have thus been proposed.

FIG. 11 shows an example of a conventional load-buffering device. As shown in the figure, a load-buffering device 1 is disposed between a location where the roll paper R is placed and a print unit 5. On one end of an arm 2 removably supported on a case so that it can pivot, the load-buffering device 1 has a roller 3 around which a part r of the pulled out roll paper is draped. A spring 4 biases the arm 2, in the counterclockwise direction in the figure, to resist a rotary movement of the arm 2 in the clockwise direction. Tension applied to the paper when the transportation roller 6 pulls the roll paper, causes the arm 2 to pivot in the clockwise direction as seen in the figure until a balance is reached between the force of the spring 4 resisting such pivotal movement and the force required to rotate the roll paper. This movement of the arm 2 causes the tension on the paper to increase gradually to the amount required to draw paper off the paper roll, in contrast to a sudden increase that would occur without the load-buffering device.

However, there are a number of problems with the above conventional load-buffering device as described below.

(1) When transport roller 6 starts pulling the paper, the direction in which the paper is pulled and the direction in which the arm 2 is moved are substantially opposite to each other. The relative distance between the transportation roller 6 and the roller 3, and between the roll part (point A in the figure) of the roll paper and the roller 3, changes according to the angle of rotation of the arm 2, resulting in excessive paper tension on one side of the roller 3 and slack in the paper on the other. As a result, smooth advancement of roll paper R is hindered.

(2) The load-buffering device 1 requires sufficient space inside the printer case to assure a sufficient range of arm 2 movement. This tends to make the printer size larger than otherwise necessary.

(3) The precision in positioning the load-buffering device to the roll paper and print unit is important in order to assure stable operation of the load-buffering device. However, this is difficult to assure in mass printer production because installing the above noted conventional load-buffering device is independent of roll paper installation. Installation is also difficult.

(4) Depending on the printer installation, it is desirable to change where the roll paper is placed relative to the printer case, or to change the orientation of the user-supplied roll paper, that is, which side of the unrolled paper faces a particular direction. It is difficult to flexibly modify the configuration or installation of a conventional load-buffering device to handle such changes.

(5) It is also common in this type of printer to use a near-end sensor for detecting when there is little paper left on the roll. When the load-buffering device is modified as noted in (4) above, however, the position of the near-end sensor must also be changed and adjusted.

SUMMARY OF THE INVENTION

An object of the present invention is to provide a buffering device that does not interfere with smooth roll paper transportation.

Another object of the present invention is to minimize the installation space requirement of the buffering device and thus enable further downsizing of the printer.

Another object of the present invention is to improve the precision in the installation of the buffering device to the roll paper position, thereby assuring stable operation of the buffering device in a mass produced printer.

Another object of the present invention is to provide a load-buffering unit that allows the installation position to be readily changed when, for example, the location where roll paper is installed to the printer case is changed or the orientation of the printing surface of user-supplied paper is changed.

Another object of the present invention is to provide a near-end sensor element on the load-buffering unit in accordance with one embodiment of the present invention, to thereby eliminate the need for near-end sensor adjustment when the position of the load-buffering unit is changed.

To achieve the above objects, a roll paper pulling load-buffering device is provided for use in a printer that prints on a surface of roll paper that is supplied to a print unit by rotation of a transportation roller that pulls from an end of the roll paper. In one aspect, the roll paper pulling load-buffering device has an arm that is rotatably disposed and rotatable within a specified angle about a shaft for roll paper rotation; a roller extending from the arm widthwise to the roll paper on the outside of the paper roll so that the pulled out part of the roll paper can be draped therearound; and an urging means for urging the arm in a direction opposite to a direction in which the arm is moved circularly by the intervening roller due to force occurring when the roll paper is transported by the transportation roller.

The major part of arm movement in a load-buffering device according to the present invention is contained within the area in which the roll paper is stored. The overall area occupied by the load-buffering device is therefore extremely small with respect to the printer. The path of roller movement is also an arc centering on the shaft on which the roll paper rotates. Paper tension on both sides of the roller supporting the paper pulled off the roll therefore does not vary greatly in conjunction with the angle to which the arm rotates, and paper can therefore be pulled smoothly off the roll.

The roll paper pulling load-buffering device of the invention may preferably have an arc shaped guide centering on the shaft for roll paper rotation. In this case the urging means is preferably an extension spring stretching and contracting along the guide.

The roll paper pulling load-buffering device in this case further preferably has a second extension spring for urging the arm in a direction opposite to the urging direction of the above-noted extension spring.

In another embodiment, the urging means of the roll paper pulling load-buffering device may preferably be formed from a torsion spring wound around the shaft for roll paper rotation.

Yet further, in a preferred embodiment, the shaft for roll paper rotation, the arm, the roller, and the urging means of this roll paper pulling load-buffering device are assembled as a unit that is removable from and installable to the printer frame.

The present invention also relates to a roll paper pulling load-buffering unit that is removably installable to a frame of a printer that prints to a surface of roll paper. The roll paper may be supplied to a print unit of the printer by rotation of a transportation roller pulling from an end of the roll paper. The roll paper pulling load-buffering unit has an arm that is rotatable within a specified angle about a shaft for roll paper rotation, a roller and an urging device. The roller extends from the arm widthwise of the roll of paper, and located above the outside periphery of the roll of paper. The roller comes in contact with a pulled out part of the roll paper that is draped therearound. The urging means urges the arm in a direction opposite to a direction in which the arm is moved circularly by the intervening roller due to force occurring when the roll paper is transported by the transportation roller.

The roll paper pulling load-buffering unit of one embodiment may further preferably have a near-end sensor element for making a detection when the amount of print medium remaining on the paper roll is less than or equal to a specified amount.

In this case, the near-end sensor element is preferably adjustably disposed to a position relative to the diameter of the paper roll. In this case the near-end sensor element is selectively installed to any of plural fixed positions, or is installed to an appropriate position within a specific range of movement.

In addition, the roll paper pulling load-buffering unit may preferably have an arc-shaped guide centering on the shaft for roll paper rotation. The urging means is a first extension spring having one end thereof fixed to the pulling load-buffering unit side, and the other end fixed to a member of the printer frame side, so that the spring extends and contracts along the guide.

Yet further, preferably, the roll paper pulling load-buffering unit in this embodiment may additionally have a second extension spring for urging the arm in a direction opposite the urging direction of the first extension spring. One end of the second extension spring is also fixed to the pulling load-buffering unit side, and the other end fixed to a member of the printer frame side.

The member on the printer frame side to which the above-noted other end of at least one of the two extension springs is mounted may be adjustable.

Yet further preferably, the above-noted guide of this roll paper pulling load-buffering unit has a protruding part that contacts the above-noted adjustable mounting member to limit circular movement of the arm.

BRIEF DESCRIPTION OF THE DRAWINGS

Other objects and attainments together with a fuller understanding of the invention will become apparent and appreciated by referring to the following description and claims taken in conjunction with the accompanying drawings, wherein:

DESCRIPTION OF THE PREFERRED EMBODIMENTS

Figure 1:
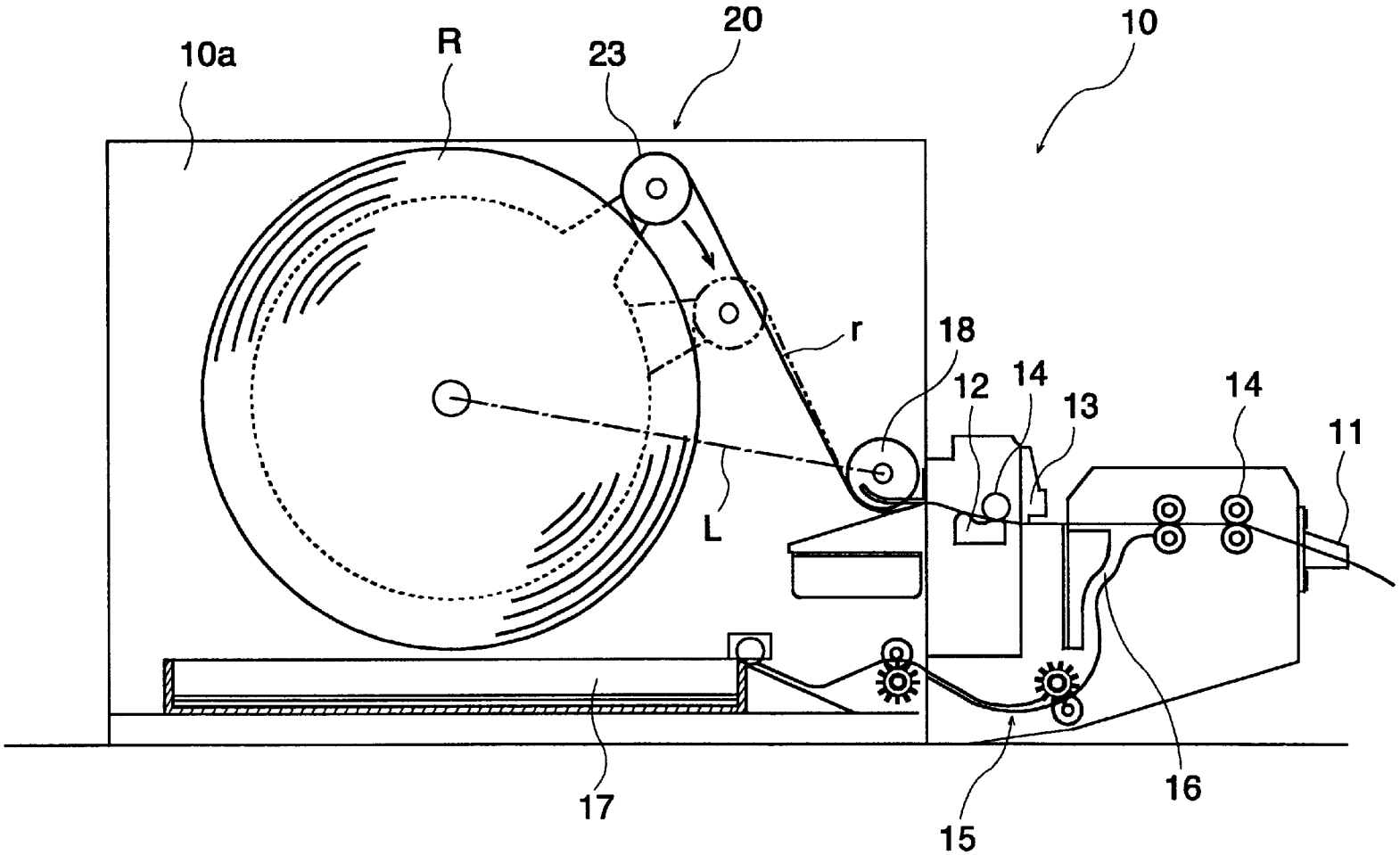
FIG. 1 is a side view showing the internal structure of a printer in which is installed a roll paper load-buffering device according to a preferred embodiment of the present invention.

The preferred embodiments of the present invention are described below with reference to the accompanying figures. FIG. 1 is a side view showing the internal structure of a printer having a roll paper load-buffering device installed therein in accordance with a preferred embodiment of the present invention. This figure shows only the internal structure, and the case constituting the outside shape of the printer is omitted.

A printer 10 is used in conjunction with a POS terminal, for example, for printing receipts, and stores roll paper R internally. A print head 12, a paper cutting mechanism 13, a plurality of transportation rollers 14, and a guide roller 18 are disposed along the paper path leading from the roll paper R housing to a roll paper exit 11. The transportation rollers 14 are appropriately driven according to a print command from the host, and the roll paper R is intermittently pulled out from the roll. Print head 12 is driven to print desired text and symbols, for example, on the roll paper R. The printed area on the roll paper R is further advanced toward the roll paper exit 11. When the trailing end of the printed area reaches a particular position relative to the paper cutting mechanism 13, the paper cutting mechanism 13 cuts the paper to separate the printed part from the roll, such that the printed part is supplied through the roll paper exit 11 as a single receipt to the user.

The printer 10 further comprises a recovery mechanism 15 for the cut receipt. If the receipt is left in the roll paper exit 11 for a specific time, the transportation rollers 14 (except for the platen roller, i.e., the transport roller shown opposite print head 12) reverse the receipt based on a command from the host to withdraw the receipt into the printer 10. The withdrawn receipt is carried to the recovery path 16, and subsequently recovered into a recovery tray 17.

The printer 10 further comprises a roll paper load-buffering device 20, which functions to avoid a sudden increase in the load on the roll paper R when the transport rollers start pulling the paper R off the roll. The load-buffering device installed in the printer 10 is described in detail below.

Embodiment 1

Figure 2:
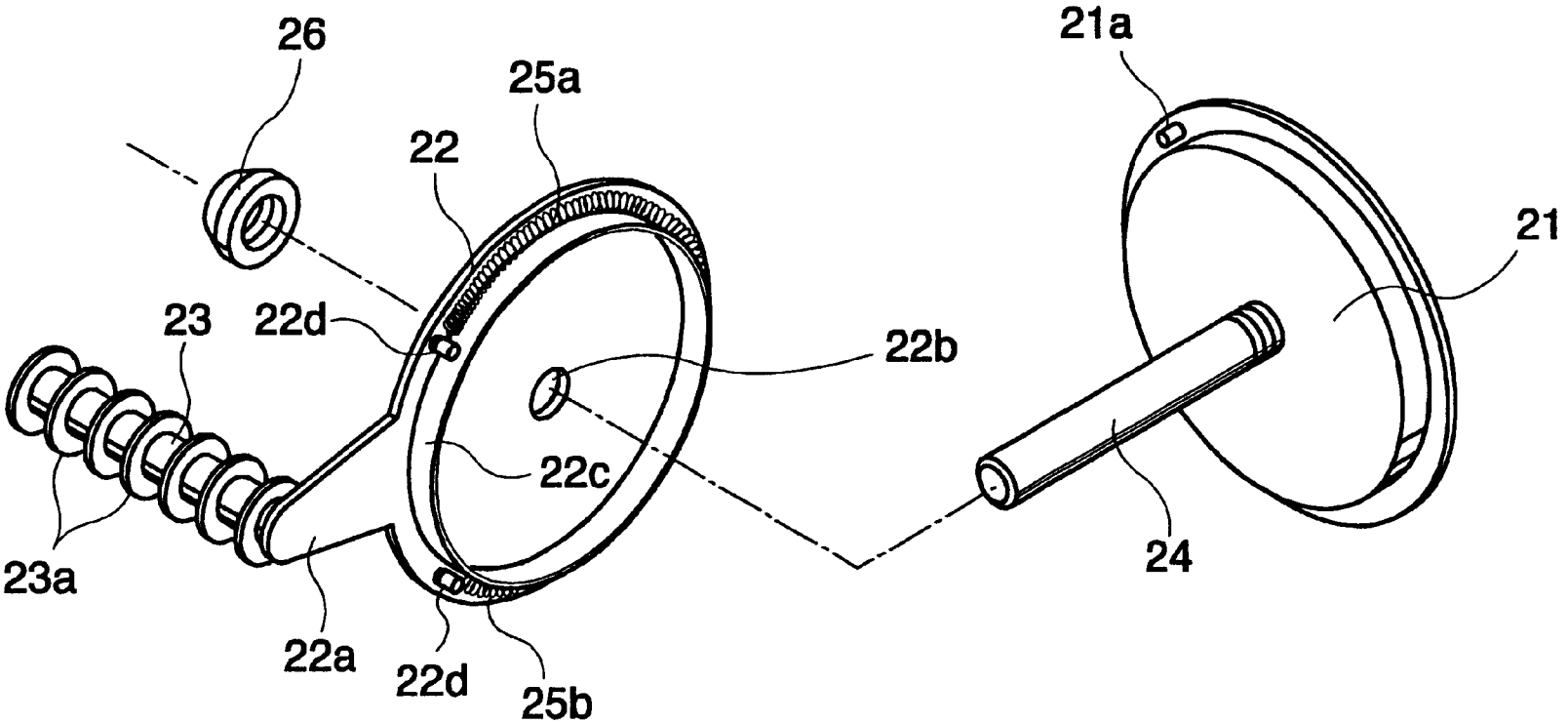
FIG. 2 is an exploded perspective view of a load-buffering device according to a preferred embodiment of the present invention.
Figure 3:
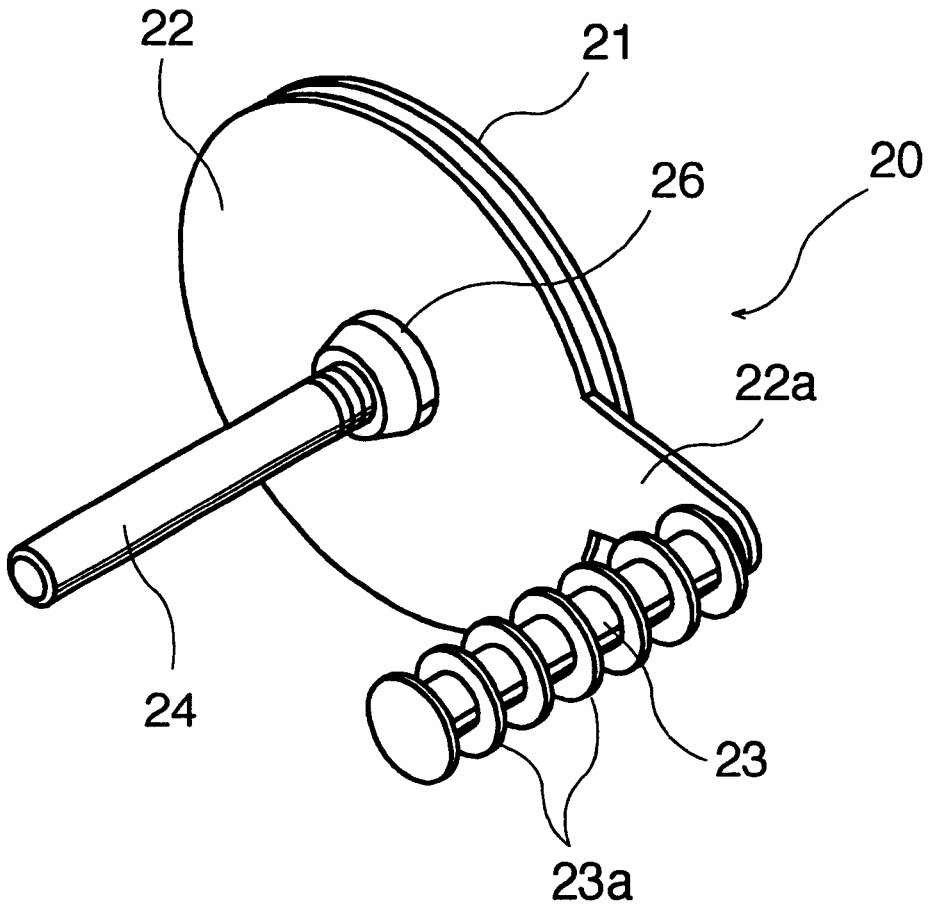
FIG. 3 is a perspective view of an assembled load-buffering device according to a preferred embodiment of the present invention.
Figure 4:
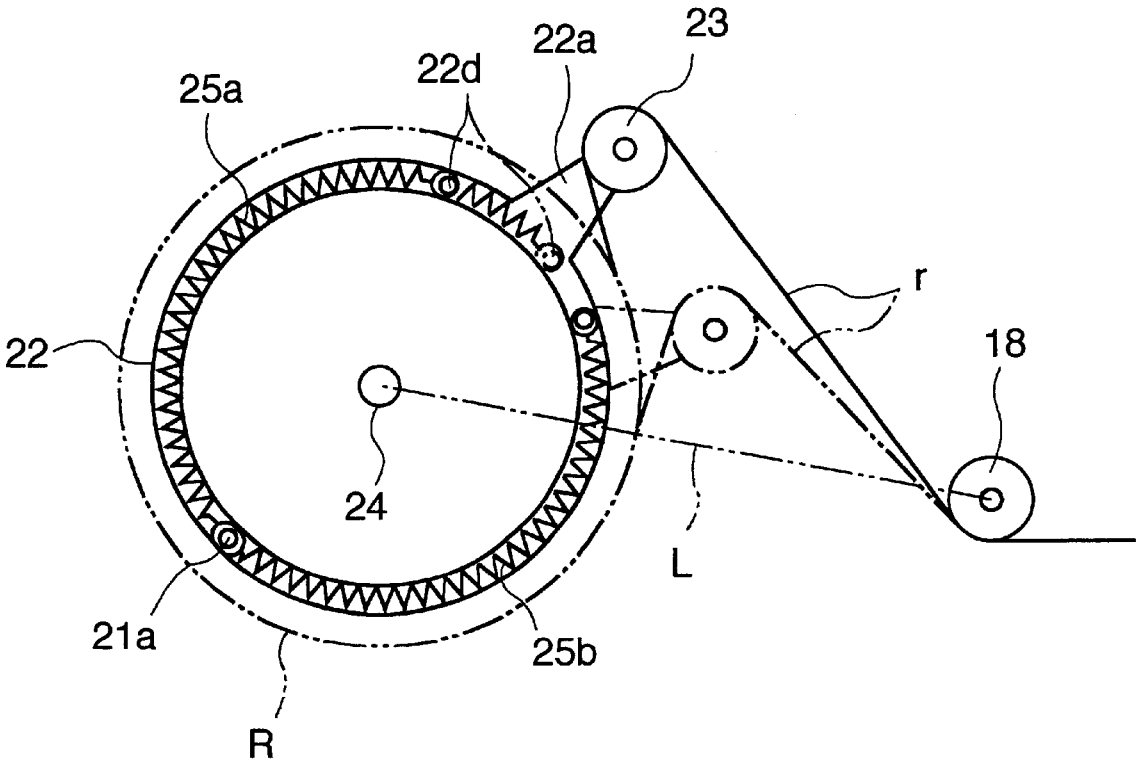
FIG. 4 is a section view showing the internal structure of a load-buffering device according to a preferred embodiment of the present invention.

A load-buffering device in accordance with a first preferred embodiment of the present invention is described below with reference to FIG. 1 and FIGS. 2 to 4. FIG. 2 is an exploded perspective view of the load-buffering device according to this preferred embodiment. FIG. 3 is a perspective view of the same when assembled. FIG. 4 is a section view showing the internal structure of the load-buffering device.

As shown in these figures, the load-buffering device 20 comprises a disc-shaped fixed plate 21, a rotating plate 22 having an arm 22*a*, and a roller 23. The fixed plate 21 is for attaching the load-buffering device 20 to the surface of a frame l0*a* of the printer. A rotary shaft 24 for the roll paper R is integral to the fixed plate 21. The fixed plate 21 may be affixed to the frame l0*a* of the printer, such that the rotary shaft 24 is also affixed to the frame. The roll paper R is supported on the rotary shaft 24 so that it can turn. A fixed pin 21*a* for securing one end of extension spring 25, further described below, is formed at an outside edge position of the fixed plate 21.

The rotating plate 22 has a disc shape conforming to the fixed plate 21, integrally comprising on one side thereof an arm 22*a* for supporting a roller 23. A round hole 22*b* for passing the rotary shaft 24 for the roll paper R is formed in the center of the rotating plate 22. By passing the rotary shaft 24 through the round hole 22*b*, the rotating plate 22 is held freely rotatably to the fixed plate 21. After attaching the rotating plate 22, a lock ring 26 is attached to the rotary shaft 24 to prevent the rotating plate 22 from slipping off the fixed plate 21.

Near the outside edge on the fixed plate 21 side thereof, the rotating plate 22 has a guide ring 22*c* following the outside circular shape of the rotating plate 22 and fixed pins 22*d*. Two extension springs 25*a* and 25*b* are disposed on the outside of the guide ring 22*c*. One end of each of the extension spring 25*a* and 25*b* is engaged with a fixed pin 22*d* formed on the rotating plate 22, and the other end is engaged with the fixed pin 21*a* formed on fixed plate 21.

The extension springs 25*a* and 25*b* function to produce a force resisting the spring extension. More specifically, when the rotating plate 22 is turned a specified angle with respect to the fixed plate 21, and the distance between the fixed pin 21*a* of the fixed plate 21 and the fixed pin 22*d* of the rotating plate 22 increases, the extension springs 25*a* and 25*b* work in a direction returning the rotating plate 22 to its original position. Because the extension springs 25*a* and 25*b* expand and contract along a guide ring 22*c*, less space is required for spring extension and contraction, space can be used more efficiently, and the direction in which the spring works also follows the direction of rotation of the rotating plate 22. There is, therefore, little dispersion of spring force, and extension spring power is efficiently transferred to the rotating plate 22. It should be noted that, in this embodiment of the invention, expansion and contraction of the extension springs 25*a* and 25*b*, and therefore spring power, is proportional to the rotational angle of the rotating plate 22.

A roller 23 is rotatably fixed on the end of the arm 22*a* of the rotating plate 22. As shown in the figures, a part of the roll paper R pulled from the roll (referred to below as a pulled part r) is draped around this roller 23. To minimize friction and resistance to the movement of the roll paper, the roller 23 has a plurality of thin circular blades 23*a* disposed thereto in the axial direction as a means of minimizing the area contacting the surface of the roll paper R. When rotating plate 22 is in its initial position, the roller 23 is positioned above a line L joining the roll paper rotary shaft 24 and the guide roller 18 upstream of the print unit. By draping the pulled part r of the roll paper around the roller 23, the roll paper is routed through a paper path in which a required specific tension is maintained on the roll paper.

It is important to note here that the above described parts of the load-buffering device 20 are assembled as a single unit before installation to the printer 10, and the load-buffering device 20 is then affixed as a unit to the frame 10*a* of the printer. As a result, the relative positions of the roll paper shaft 24 and the roller 23 are maintained with good precision, and problems arising from imprecise positioning during installation to the printer, for example, can be avoided.

The operation of the load-buffering device 20 is described next. When transportation by the transportation rollers 14 of the roll paper pulled part r begins in response to a print command from the host, a pulling force acts on the roll paper roll as the transportation rollers 14 attempt to pull the paper out from the roller. Inertia prevents the roll from turning immediately in response to this pulling force, which thus causes the roller 23 of the load-buffering device to be pulled in a substantially downward direction as indicated by a double-dot and dash line in FIG. 1. The rotating plate 22 is thereby turned a specified angle in resistance to the extension spring 25*a*, and the roll paper is transported. A well balanced distribution of tension applied to the roller paper on both sides of the roller 23 is thus achieved because the roller 23 is turned a specified angle around the axis of rotation of the roll paper. Thus, the situation where tension is high on one side and low on the other of the roller 23 is avoided. As a result, the roll paper can be stably transported.

When the rotating plate 22 of the load-buffering device is turned by the pull of the transportation rollers 14 on the roll paper, the extension spring 25*a* is stretched. When the transport rollers 14 stop pulling the paper or when the speed of the transport rollers becomes constant after acceleration, the energy thus stored in the spring 25*a* turns the rotating plate 22 in the opposite direction. The rotation of the rotating plate 22 back toward its initial position (balanced position) pulls the pulled part r of the roll paper draped around the roller 23 circumferentially around the roll paper. The force of this causes the rolled part of the roll paper to turn gradually in the unwinding direction, and the roll paper is smoothly paid out. Because the rotating plate 22 supporting the roller 23 is supported axially to roll the paper rotary shaft 24, the pulled part r of the roll paper is pulled circumferentially to the roll paper. It is therefore possible to efficiently apply torque to the roll paper, and assure that the roll paper is paid out smoothly.

It should be noted that, in accordance with the embodiment of the invention, the roller 23 of the load-buffering device is shown positioned above line L with the pulled part r of the roll paper routed above and around the roller 23. However, it is also possible to invert the direction in which the roll paper is loaded (that is, so that the paper is pulled out from the top of the roll), to position the roller 23 below line L, and to route the pulled part r of the roll paper to the bottom so that it passes below the roller 23. In this case, the other extension spring 25*b* of the load-buffering device works instead of the spring 25*a* with respect to rotation of the rotating plate 22. In other words, the above noted load-buffering device 20 can be used whether the roll paper R is paid out from the top or the bottom of the roll (see FIG. 8 and FIG. 9).

It will thus be obvious that the load-buffering device of this preferred embodiment can be adapted to the paper path and position of the print head to the roll paper. Roll paper having the printing surface on the inside, and the roll paper having the printing surface on the outside, can both be used with this load-buffering device. This is particularly beneficial when using thermal paper or preprinted paper because the printing surface of such paper is predetermined.

Embodiment 2

Figure 5:
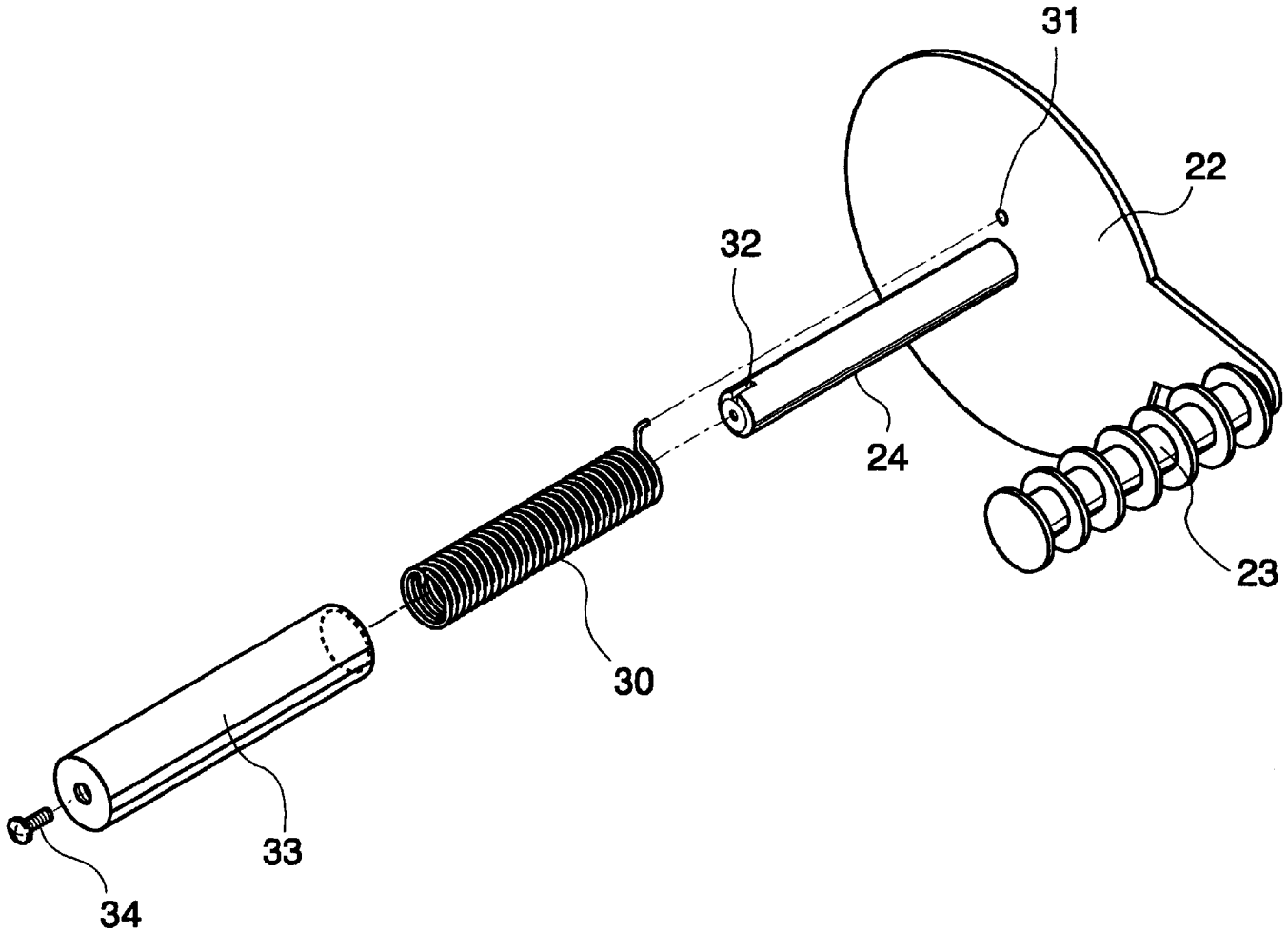
FIG. 5 is an exploded perspective view of a load-buffering device according to another embodiment of the present invention.

FIG. 5 is an exploded perspective view showing a load-buffering device according to another preferred embodiment of the present invention. Like parts in this embodiment and the above embodiment are identified by the same reference numerals, and further description thereof is omitted. The present embodiment differs from the previous embodiment in that the urging means of the rotating plate 22 is a torsion spring 30 mounted to the rotary shaft 24 for the roll paper. As shown in the figure, one end of the torsion spring 30 is engaged with a hole 31 formed in the rotating plate 22, and the other end is engaged with a slot 32 in the end of the roll paper rotary shaft 24. A tubular cover 33 is mounted on the rotary shaft 24 on the outside of the torsion spring 30 by means of a screw 34 so that roll paper R and the torsion spring 30 do not interfere with each other.

When the roll paper R is pulled by transportation rollers 14 and the rotating plate 22 is turned from its initial position, the torsion spring 30 is twisted and works to return the rotating plate 22 to its initial position. As a result of this operation, the roll paper R is smoothly paid out in the same manner as in the previous embodiment.

Embodiment 3

Figure 6:
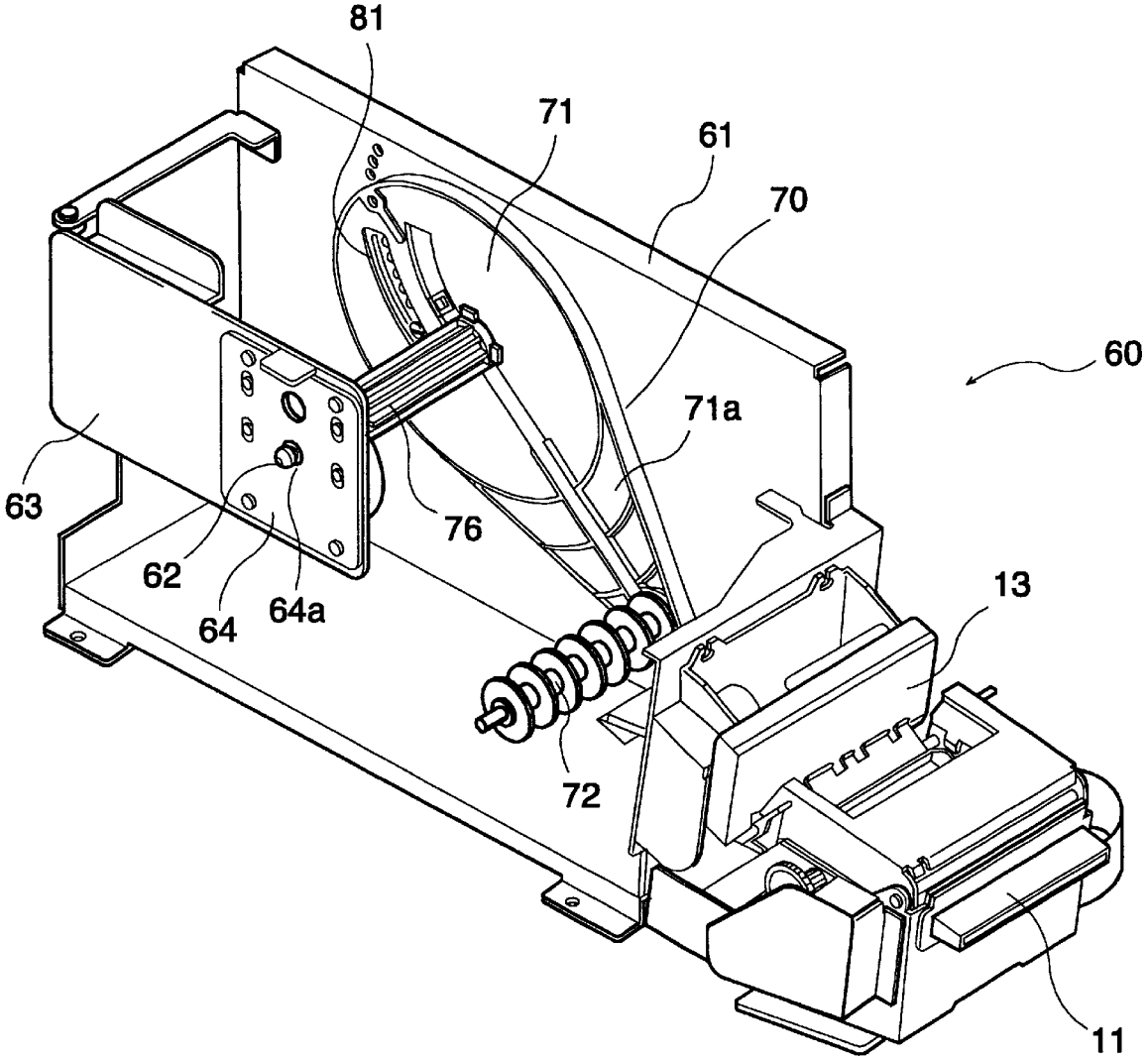
FIG. 6 is a perspective view showing the internal configuration of a printer having installed thereto a pulling load-buffering device according to a further embodiment of the present invention.
Figure 7:
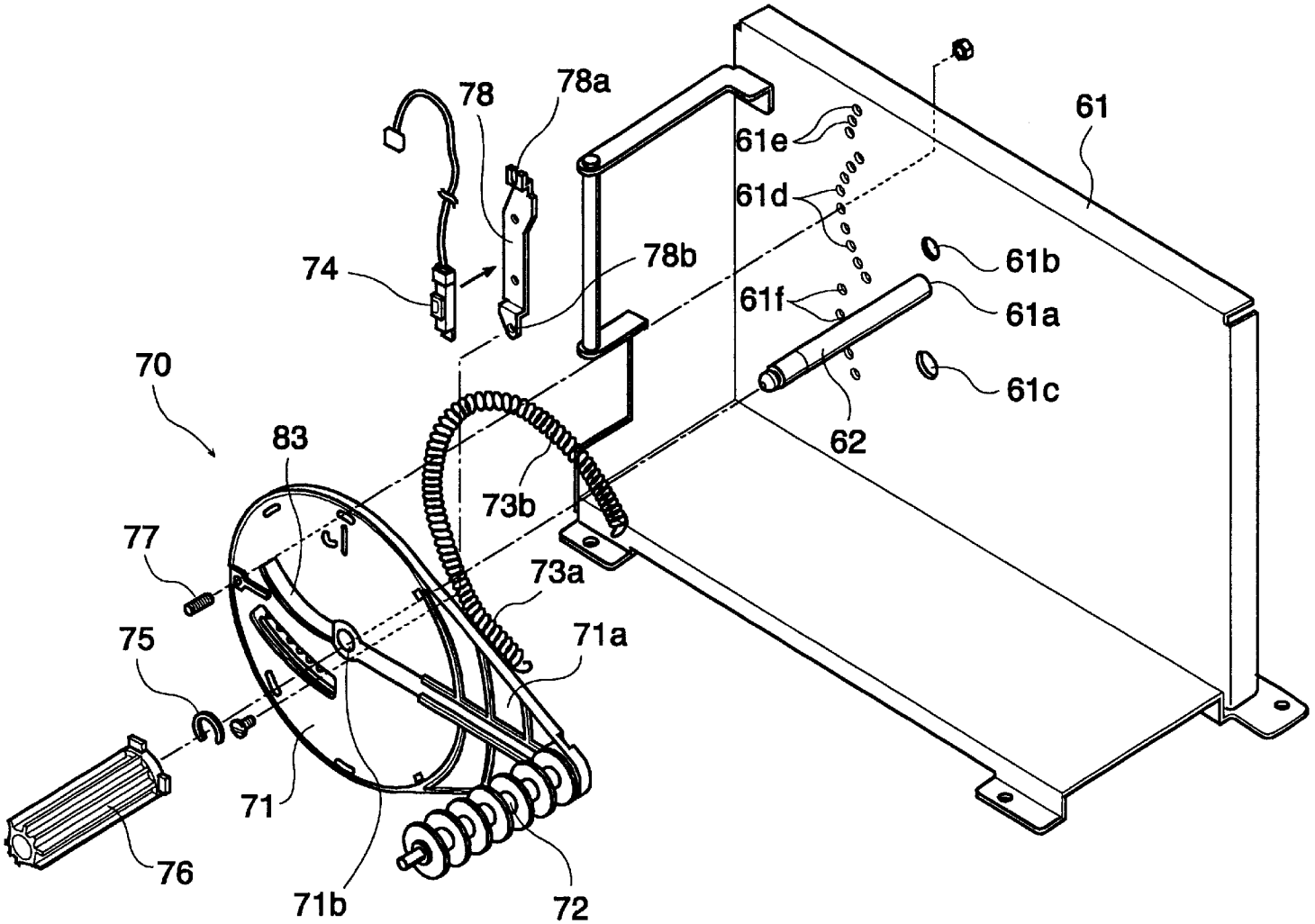
FIG. 7 is an exploded view of FIG. 6.
Figure 8:
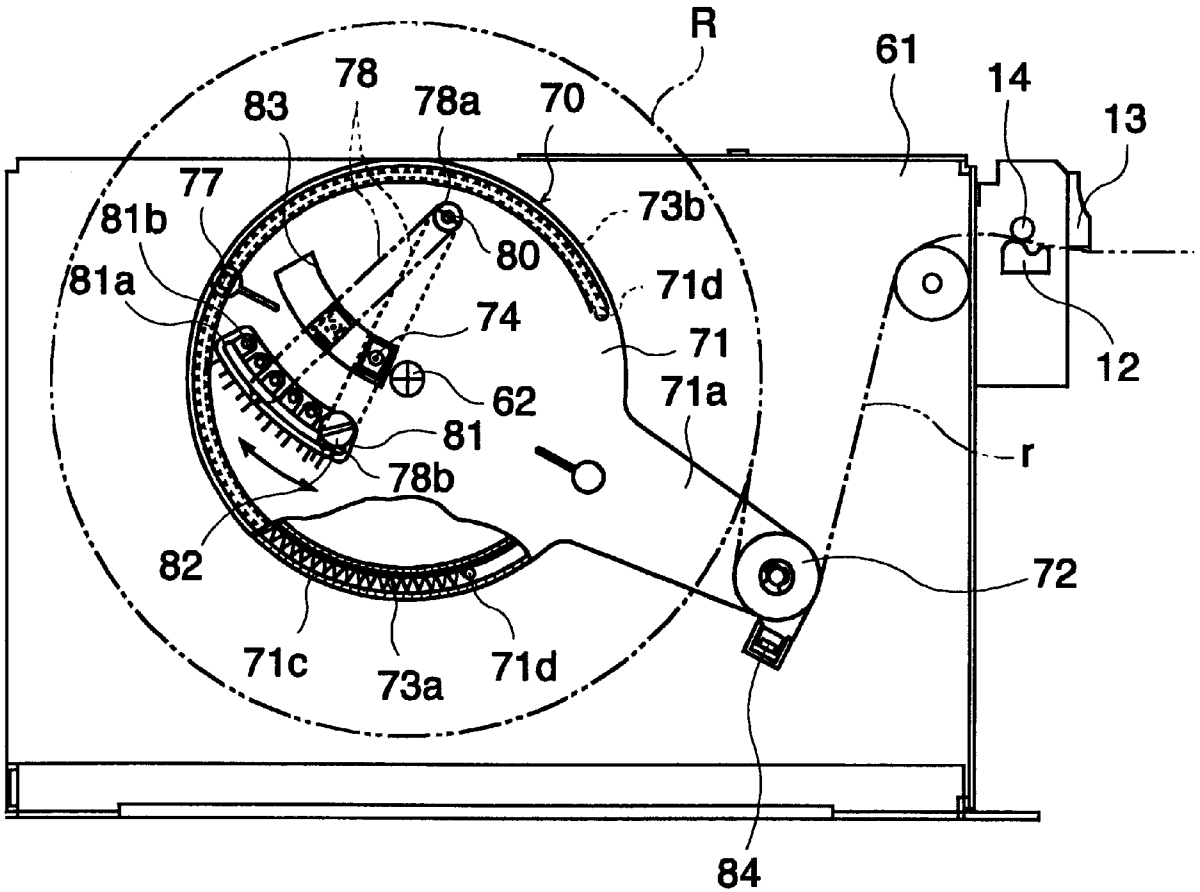
FIG. 8 is a side view of FIG. 6.

FIGS. 6 to 10 show a printer having a roll paper pulling load-buffering device according to another embodiment of the present invention. FIG. 6 is a perspective view showing the internal structure of a printer having this pulling load-buffering device, FIG. 7 is an exploded view of the same, and FIG. 8 is a side view of the same. It should be noted that a printer according to this preferred embodiment of the invention is basically the same as the printer 10 shown in FIG. 1, and further description of its basic configuration is therefore omitted below.

As shown in these figures, the frame 61 of a printer 60 according to this preferred embodiment forms an internal storage area in which the roll paper R is held. A rotating shaft 62 for rotatably supporting the roll paper R is fixed to a sidewall of the frame 61. A plurality of holes 61*a* to 61*c* to which the base end of the rotating shaft 62 can be inserted and secured are formed in the wall of the frame 61. As a result, the rotating shaft 62 can be appropriately secured to one of these holes 61*a* to 61*c* according to the application.

The printer 60 further comprises a load-buffering unit 70, which is mounted to the rotating shaft 62. The load-buffering unit 70 according to this preferred embodiment of the invention has a rotating plate 71 with an arm 71*a*, a roller 72, extension springs 73*a*, 73*b*, and a photointerrupter 74 functioning as a near-end sensor element for detecting when the roll paper supply is nearly ended.

The rotating plate 71 has substantially the same disk shape as the rotating plate 22 of the above-described embodiments, and has an arm 71*a* for supporting the roller 72. A hole 71*b* for passing the roll paper rotating shaft 62 is formed in the center of the rotating plate 71. The rotating plate 71 can thus be held freely rotatably to the frame 61 by passing the hole 71*b* over the rotating shaft 62. After installing the rotating plate 71, a lock ring 75 is fit to the rotating shaft 62 to prevent the rotating plate 71 from slipping off the rotating shaft 62. A roll paper holder 76 is fit onto the rotating shaft 62 after installing the rotating plate 71. The roll paper R can then be fit onto the roll paper holder 76.

A support plate 63 is further disposed to the printer frame 61. A hole in the support plate 63 supports the other end of the rotating shaft 62, and the support plate 63 thus functions as a guide for the roll paper R carried on the roll paper holder 76. A slide plate 64 is disposed to the support plate 63 so that it can slide slightly relative to the support plate 63. A hole 64*a* is formed in the slide plate 64 slightly offset from the hole in the support plate 63 so that, when the end of the rotating shaft 62 is inserted through these holes, the edge of hole 64*a* engages a channel in the end of the rotating shaft 62. The support plate 63 is installed so that it can move circularly to the frame 61 such that the support plate 63 is opened when loading the roll paper R to the rotating shaft 62, and closed when the roll paper R and the printer are in use.

As shown in FIG. 8, the rotating plate 71 has a circular guide channel 71*c* around the outside edge on the frame 61 side of the rotating plate 71. Two extension springs 73*a* and 73*b* are disposed inside this guide channel 71*c*. One end of each extension spring 73*a* and 73*b* engages a fixed pin 71*d* formed on the rotating plate 71, and the other end of each spring engages a mounting pin 77 disposed to the frame 61. As in the preceding embodiments, each of the extension springs 73*a* and 73*b* works to produce a restoring force opposing spring extension. As a result, when the rotating plate 71 is turned relative to the frame 61 and the distance between the frame-side mounting pin 77 and the fixed pin 71*d* on the rotating plate 71 increases, one of the springs is stretched tending to return the rotating plate 71 to its initial position, while the other spring is relieved.

It should be noted that the resting position (that is, angle) of the rotating plate 71 and therefore the roller 72 relative to the frame 61 is determined by the point at which the tension between the two extension springs 73*a* and 73*b* is balanced. A plurality of mounting holes 61*d* for the mounting pin 77, on which one end of the extension springs is mounted, is formed in the wall of the frame 61 in an arc centering on the rotating shaft 62. It is therefore possible to adjust the position to which the mounting pin 77 is installed.

Figure 9:
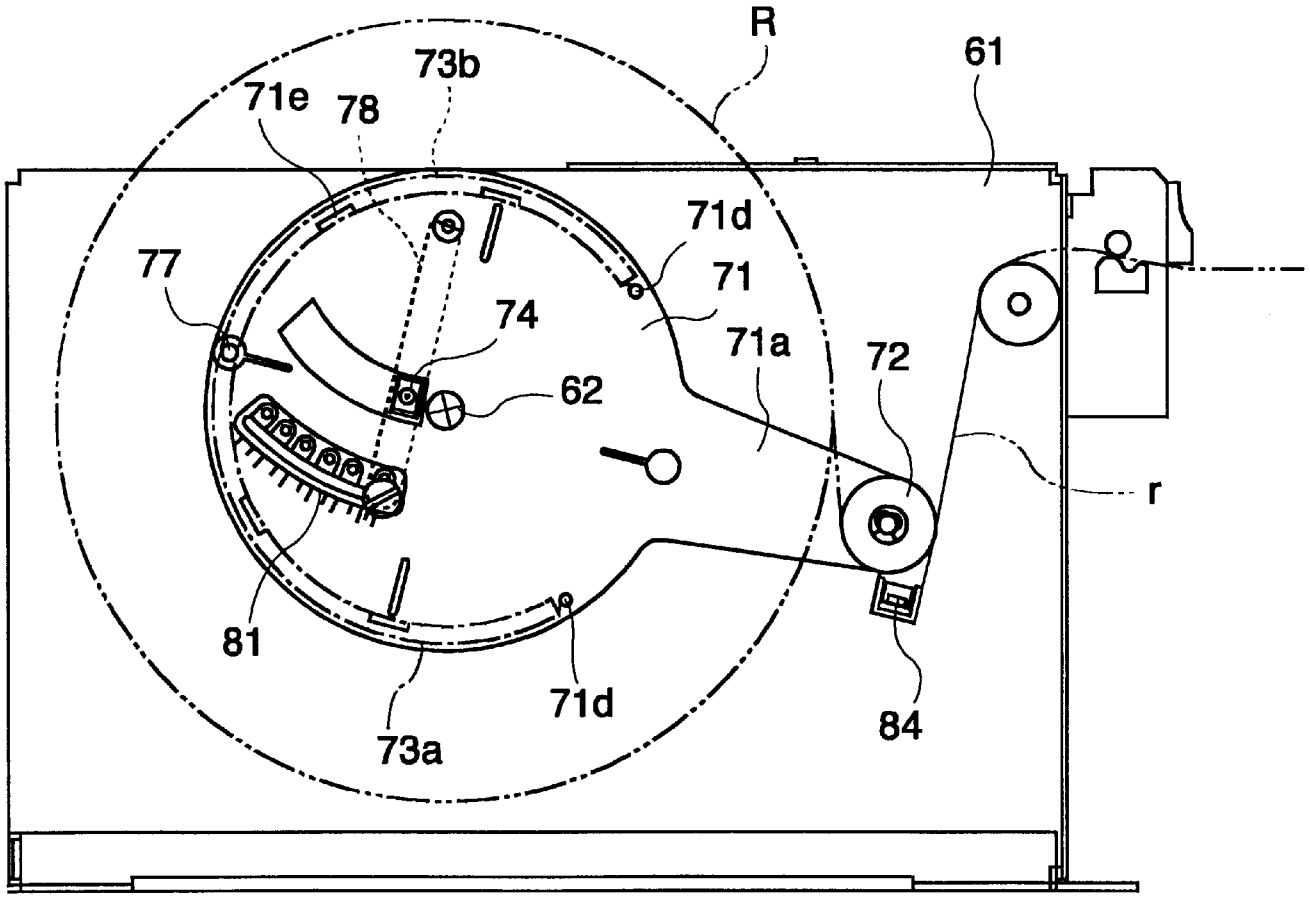
FIG. 9 is a side view of an extension spring installation using a mounting hole different from that shown in FIG. 8.

FIG. 9 shows what happens when the extension springs 73*a* and 73*b* are mounted to a mounting pin 77 inserted to a hole 61*d* different from that used in the installation shown in FIG. 8. As shown by these figures, the installation angle of the rotating plate 71 and the roller 72 relative to the frame 61 can be changed by changing the position of the mounting pin 77 and thereby adjusting the point at which the tension of the two extension springs 73*a* and 73*b* is balanced. It should be noted that when the rotating shaft 62 is fixed to the hole 61*b* or 61*c*, the holes 61*e* and 61*f* are used for the same purpose as holes 61*d* in this example.

The roller 72 is rotatably secured to one end of the arm 71*a* disposed to the rotating plate 71. The roller 72 is substantially the same as the roller 23 in the above-noted embodiments, and further description thereof is thus omitted below. By draping the pulled out part r of the roll paper R around the roller 72, a roll paper transportation path whereby the required specific tension is held on the roll paper is formed as also described above.

As noted above, the load-buffering unit 70 according to this preferred embodiment has a photointerrupter 74. The photointerrupter 74 functions as a near-end sensor for the roll paper R installed to the rotating shaft 62, that is, as a sensor for detecting when the end of the roll paper is near. The photointerrupter 74 is adjustably installed by means of an intervening bracket 78 to the rotating plate 71. As shown in FIG. 7 and FIG. 8, the bracket 78 is a long plate having between the end mounting parts 78*a* and 78*b* thereof a mounting area for the photointerrupter 74.

A stud 80 for pivotally engaging one bracket mounting part 78*a*, and an adjustable mounting part 81 enabling the position of the other bracket mounting part 78*b* to be changed, are disposed to the surface of the rotating plate 71.

The adjustable mounting part 81 has an arc-shaped screw channel 81*a* centering on the stud 80, and a plurality of screw holes 81*b* disposed along this screw channel 81*a*. The corresponding mounting part 78*b* of bracket 78 is fastened by means of a setting screw 82 to either one of the screw holes 81*b* or a desired position in the screw channel 81*a*. The functional surface of photointerrupter 74 installed to the rotating plate 71 by way of intervening bracket 78 thus peers at the side end of the roll paper R through a slit 83 extending radially to the roll paper R. The photointerrupter 74 can be fixed at any desirable position from the rotating shaft 62 by appropriately fastening the one end of the bracket 78 to the screw channel 81*a*. In addition, by fastening the end of the bracket 78 to one of the screw holes 81*b*, the photointerrupter 74 can be fastened at a stepped position from the rotating shaft 62.

As shown in FIG. 8, the load-buffering unit 70 according to this preferred embodiment further comprises a photointerrupter 84 as a paper end sensor element on the end of the rotating plate arm 71*a*. This photointerrupter 84 is disposed with the functional surface thereof facing the roll paper draped around the roller 72. The photointerrupter 84 thus detects when all of the roll paper R has been used and the end thereof passes the photointerrupter 84, at which point it outputs a signal indicating the end of the roll paper R. The installation position of this photointerrupter 84 can be adjusted according to the load-buffering unit 70 installation, or more specifically according to the direction and angle of the roll paper on the roller 72.

Embodiment 4

Figure 10:
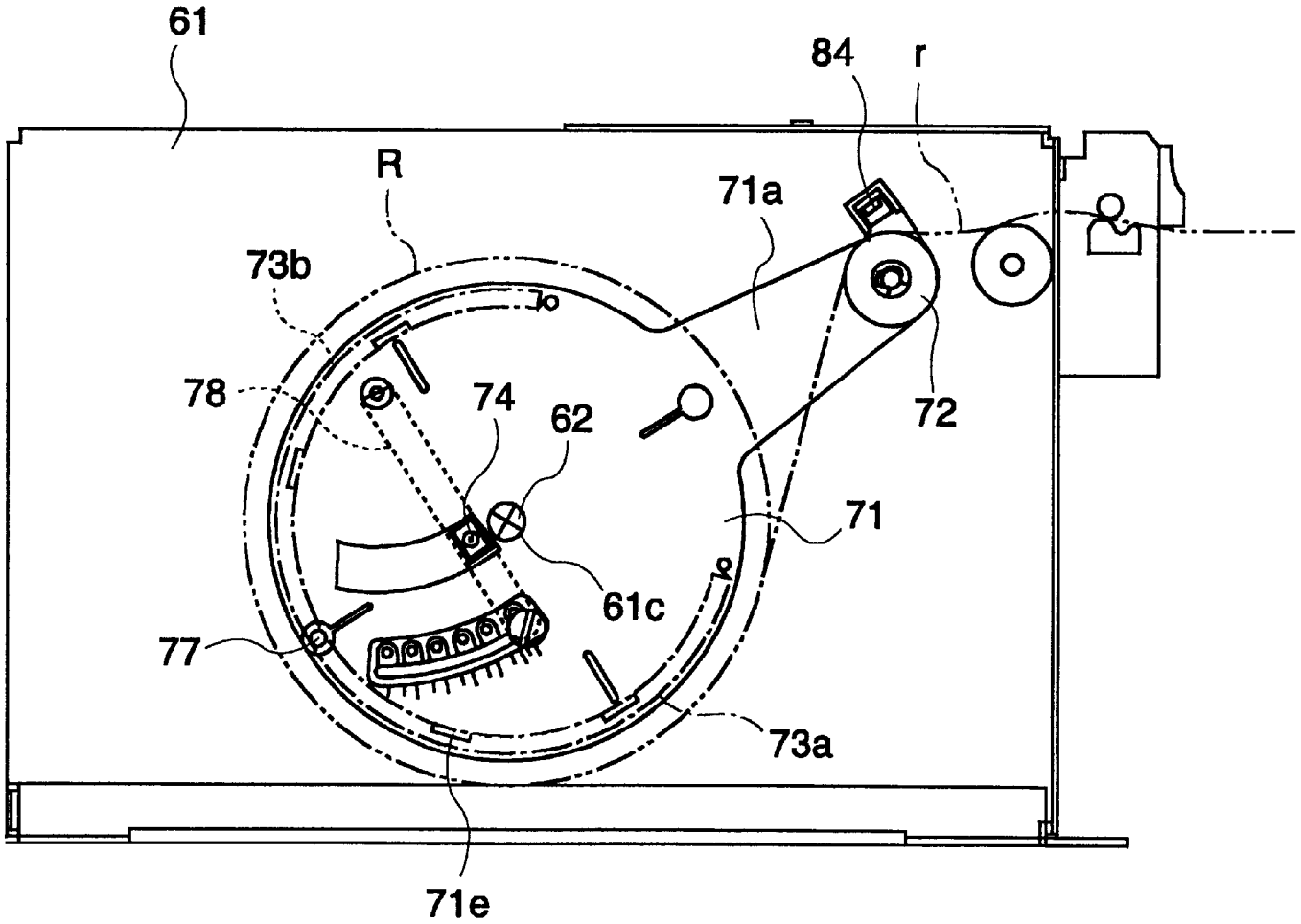
FIG. 10 is a side view of another installation of the load-buffering unit shown in FIG. 6 to the printer case.
Figure 11:
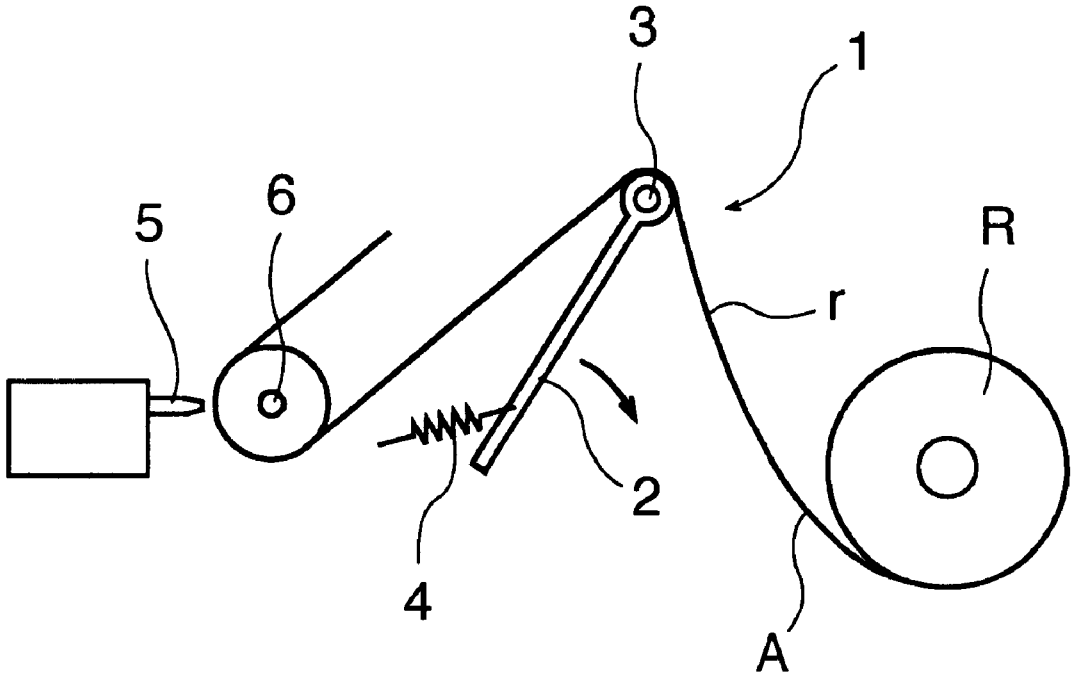
FIG. 11 shows an example of a conventional load-buffering device.

FIG. 10 is a side view showing an alternative installation of the above-noted load-buffering unit 70 to a printer frame. In this example, the orientation of the roll paper R installed to the rotating shaft 62 is opposite of the orientation shown in FIG. 8 and FIG. 9. More specifically, the end r of the roll paper in this embodiment is pulled out from the bottom of the roll, passed over the top of the roller 72, and fed from there to the printing unit. The following steps are conducted to change the installation shown in FIG. 8 to that shown in FIG. 10.

First, the load-buffering unit 70 is removed from the rotating shaft 62. This is accomplished by removing the extension spring mounting pin 77, and removing the roll paper holder 76 and the lock ring 75. Next, the rotating shaft 62 is removed from the hole 61*a* in the frame 61, and reinstalled to the hole 61*c*. The load-buffering unit 70 is then fit onto the rotating shaft 62 and secured by means of the lock ring 75 and the roll paper holder 76. The mounting pin 77 is then inserted to one of the holes 61*f* selected appropriately according to the desired angle of the rotating plate 71, and one end of each extension spring 73 is then engaged with the mounting pin 77. Finally, the photointerrupter 84 used as a paper end sensor is adjusted to complete the change in the position of the load-buffering unit 70 installation.

What is important in the above procedure is that it is not necessary to change or adjust the position of the photointerrupter 74 used as a near-end sensor according to the change in the position of the load-buffering unit 70. In a printer using a load-buffering unit according to this preferred embodiment of the invention, changing the installation position of the photointerrupter 74 relative to the rotating shaft 62 on which the roll paper is carried is completed when the position of the load-buffering unit 70 itself is changed.

It should be noted that protrusions 71*e* are disposed to the rotating plate 71 adjacent to the inner side of the guide channel 71*c* and assist the guide channel in guiding the extension springs 73*a* and 73*b* and prevent spring dislocation. A protrusion 71*e* contacts a mounting pin 77 when the rotating plate 71 rotates, and thus functions as a stop for preventing the rotating plate 71 from turning more than a predetermined distance.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom. For example, rotating plate 22, 71 has been described as a disk shaped member in the above embodiments, but other shapes will obviously be possible insofar as the roller 23, 72 can move circularly centering on the roll paper rotary shaft 24, 62.

The following benefits are obtained by means of the present invention as described above.

(1) The greater part of the range of arm movement in the present invention is contained within the space in which the roll paper is contained. As a result, the installation space requirement of the overall load-buffering device relative to the printer is extremely small, and therefore does not hinder downsizing the printer.

(2) The path of roller movement is an arc centering on the shaft around which the roll paper rotates. Tension on both sides of the roller supporting the pulled out part of the roll paper therefore does not change greatly due to the angle of arm rotation, and roll paper can therefore be smoothly pulled out.

(3) The roll paper rotary shaft, the arm, the roller, and the urging means are formed into a unit that can be installed to and removed from the printer case. As a result, the precision with which the buffering device is installed relative to the position of the roll paper can be easily improved, and stable buffering device operation can therefore be assured in a mass produced printer.

(4) The load-buffering device of the present invention is provided as a single unit. As a result, the end-user's desires to change the position of roll paper installation with respect to the frame according to the printer application and installation, or to change the user-supplied roll paper, that is, which side of the roll paper is printed to, can be flexibly addressed.

(5) It is not necessary to change or adjust the installation or position of the near-end sensor in conjunction with a change in the position of the roll paper installation, and it is therefore easy to change the roll paper installation.

What is claimed is:

1. A roll paper pulling load-buffering device for use in a printer having a print unit that prints on a surface of roll paper that is pulled from a paper roll and supplied to the print unit by rotation of a transportation roller, the roll paper pulling load-buffering device comprising:

an arm rotatable within a specified angle about a center shaft for the roll paper;

a roller extending from the arm widthwise of the roll paper on the outside of the roll paper;

an urging means for urging the arm in a direction opposite to a direction in which the arm is moved circularly by a pulling force occurring when the roll paper is transported by the transportation roller; and an arc shaped guide centered on the center shaft for the roll paper, wherein the urging means is a first extension spring that stretches and contracts along the guide.

2. The roll paper pulling load-buffering device in a printer as described in claim 1, comprising a second extension spring for urging the arm in a direction opposite to the urging direction of the first extension spring.

3. The roll paper pulling load-buffering device in a printer as described in claim 1, wherein the center shaft for the roll paper, the arm, the roller, and the urging means are formed in a unit removable from and installable to a printer frame.

4. A roll paper pulling load-buffering unit removably installable to a frame of a printer, the printer having a print unit that prints to a surface of roll paper pulled from a paper roll and supplied to the print unit by rotation of a transportation roller, the roll paper pulling load-buffering unit comprising:

an arm rotatable within a specified angle about a center of a shaft for rotating the roll paper;

a roller extending from the arm widthwise of the roll paper on the outside of the paper;

an urging means for urging the arm in a direction opposite to a direction in which the arm is moved circularly by a pulling force occurring when the roll paper is transported by the transportation roller; and an arc-shaped guide centering on the shaft for rotation of the roll paper, wherein the urging means is a first extension spring disposed along the guide, the first extension spring stretching and contracting along the guide with one end thereof fixed to the pulling load-buffering unit, and the other end fixed to the frame of the printer.

5. The roll paper pulling load-buffering unit in a printer as described in claim 4, further comprising a near-end sensor element for detecting when an amount of print medium remaining in the rolled part of the paper roll is less than or equal to a specific amount.

6. The roll paper pulling load-buffering unit in a printer as described in claim 5, wherein the near-end sensor element is adjustably disposed to a position relative to the diameter of the paper roll.

7. The roll paper pulling load-buffering unit in a printer as described in claim 6, wherein the near-end sensor element is selectively installed to any of plural fixed positions.

8. The roll paper pulling load-buffering unit in a printer as described in claim 6, wherein the near-end sensor element is installed to an appropriate position within a specified range of movement.

9. The roll paper pulling load-buffering unit in a printer as described in claim 4, further comprising a second extension spring for urging the arm in a direction opposite to the urging direction of the first extension spring, one end of the second extension spring fixed to the pulling load-buffering unit, and the other end fixed to the frame of the printer.

10. The roll paper pulling load-buffering unit in a printer as described in claim 9, wherein the other end of the second extension spring is fixed to an adjustable mounting position on the frame of the printer.

11. The roll paper pulling load-buffering unit in a printer as described in claim 4, wherein the other end of the first extension spring is fixed to an adjustable mounting position on the frame of the printer.

12. The roll paper pulling load-buffering unit in a printer as described in claim 4, wherein the guide comprises a protruding part for contacting the adjustable mounting position in association with circular movement of the arm.

13. A printer comprising a roll paper pulling load-buffering unit as described in claim 4.

14. The printer as described in claim 13, further comprising a paper end sensor for detecting an end of paper pulled from a paper roll, the paper end sensor being disposed proximally to the roller of the pulling load-buffering unit.

15. The printer as described in claim 13 having multiple installation positions for the pulling load-buffering unit on the frame.

16. The printer as described in claim 14 having multiple installation positions for the pulling load-buffering unit on the frame.

17. A roll paper pulling load-buffering device for use in a printer having a print unit that prints on a surface of roll paper that is pulled from a paper roll and supplied to the print unit by rotation of a transportation roller, the roll paper pulling load-buffering device comprising:

an arm rotatable within a specified angle about a center shaft for the roll paper;

a roller extending from the arm widthwise of the roll paper on the outside of the roll paper; and an urging means for urging the arm in a direction opposite to a direction in which the arm is moved circularly by a pulling force occurring when the roll paper is transported by the transportation roller;

wherein the center shaft for the roll paper, the arm, the roller, and the urging means are formed in a unit removable from and installable to a printer frame.

18. The roll paper pulling load-buffering device in a printer as described in claim 17, wherein the urging means is a torsion spring wound about the center shaft for the roll paper.

19. The roll paper pulling load-buffering device in a printer as described in claim 17, further comprising an arc shaped guide centered on the center shaft for the roll paper.

wherein the urging means is a first extension spring that stretches and contracts along the guide.

20. The roll paper pulling load-buffering device in a printer as described in claim 19, comprising a second extension spring for urging the arm in a direction opposite to the urging direction of the first extension spring.

* * * * *